United States Patent [19]

Piercey

[11] 3,982,355

[45] Sept. 28, 1976

[54] ADJUSTABLE BLIND STRUCTURE

[76] Inventor: Anthony C. Piercey, 40 West Way, Heston, Hounslow, Middlesex, England

[22] Filed: Feb. 20, 1976

[21] Appl. No.: 659,914

[30] Foreign Application Priority Data

Mar. 19, 1975 United Kingdom ..... 11442/75

[52] U.S. Cl. ..... 49/74; 49/82; 248/223

[51] Int. Cl.[2] ..... E05F 17/00; E06B 7/086

[58] Field of Search ..... 49/74, 77, 79, 82, 86, 49/87; 248/73, 223–225

[56] References Cited

UNITED STATES PATENTS

| | | | |
|---|---|---|---|
| 1,871,685 | 8/1932 | Goldfisher | 49/87 |
| 2,310,086 | 2/1943 | Howard | 49/86 |
| 2,887,153 | 5/1959 | Longley | 49/74 |

FOREIGN PATENTS OR APPLICATIONS

| | | | |
|---|---|---|---|
| 1,096,247 | 12/1967 | United Kingdom | 49/82 |

*Primary Examiner*—Peter M. Caun
*Attorney, Agent, or Firm*—Bacon & Thomas

[57] ABSTRACT

A pivoted slat blind structure is supported by resilient channels of the required length extending along opposite sides of an opening. The slats are pivotally supported by arms extending from a plurality of identical interlocking brackets releasably positioned in the channels.

7 Claims, 6 Drawing Figures

ADJUSTABLE BLIND STRUCTURE

BACKGROUND OF THE INVENTION

This invention is in the field of adjustable shutters or blinds.

In many instances it is desirable to provide slatted shutter devices over openings such as windows or skylights, which shutters may be opened or closed at will without moving the slats closer together as in the conventional venetian blind arrangements. It is known to provide such adjustable shutters but in most instances it was necessary to construct the mechanisms to fit the particular opening, thus necessitating stocking a relatively large number of parts to be able to install such blinds on openings of different sizes. An example of the prior practice in this regard is shown in the patent to Longley U.S. Pat. No. 2,887,153. FIGS. 5 to 8 thereof illustrate the basic features referred to wherein the slats 2 are pivotally supported on the ends of legs or brackets 11 constituting integral parts of elongated member 12. The member 12 and its integral brackets must be individually fitted to the desired opening by being constructed to the proper length.

SUMMARY OF THE INVENTION

This invention contemplates an adjustable blind structure assembled from modular units whereby any desired number may be assembled to provide proper shutter structure for any size opening likely to be encountered.

It is, therefore, a principal object of this invention to provide an adjustable shutter structure wherein slat supporting brackets are provided in identical modular form permitting any selected number to be assembled into a single blind structure.

It is a further object of the invention to provide a device as set forth in the previous object wherein the modular units may be assembled without special tools and wherein they include interlocking features to hold them assembled into a unitary structure.

DESCRIPTION OF THE PREFERRED EMBODIMENTS

Figure 5:
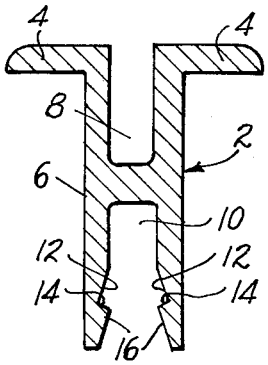
FIG. 5 is an enlarged sectional view of a supporting rail constituting one feature or the present invention.

In providing an adjustable blind structure for a window or skylight opening, applicant contemplates the mounting of a supporting rail along each of opposite sides of the opening, the rails support opposed brackets to which the end portions of individual slats are pivoted for operation in unison to open or closed position. In the drawings, numeral 2 indicates a contemplated form of elongated rail for supporting in blind structure. The rail 2 is of uniform outline throughout its length although it is contemplated that one end may be closed. The sectional shape of the rail is best shown in FIG. 5 and it is obvious that it may be expeditiously and economically formed by extrusion of either a suitable plastic material or a metal such as aluminum. The rail is provided with flanges 4 by which it may be secured to the frame surrounding the usual window or skylight opening. The rail is of generally T shape, the flanges 4 constituting the top and body 6 constituting the stem of the T. As shown, the stem of the T is of substantial thickness but is longitudinally channeled in its upper region, as shown at 8, to reduce the weight thereof. The lower end of the stem 6 is longitudinally channeled to define a downwardly open channel 10 having angular grooves 12 formed in opposite side walls, the grooves being defined by upper inwardly sloping surfaces and lower abutment surfaces 14, all as clearly shown in FIG. 5. The sides of the channel 10 below the grooves 12 taper inwardly as at 16 to facilitate insertion of the modular bracket units to be described.

Figure 1:
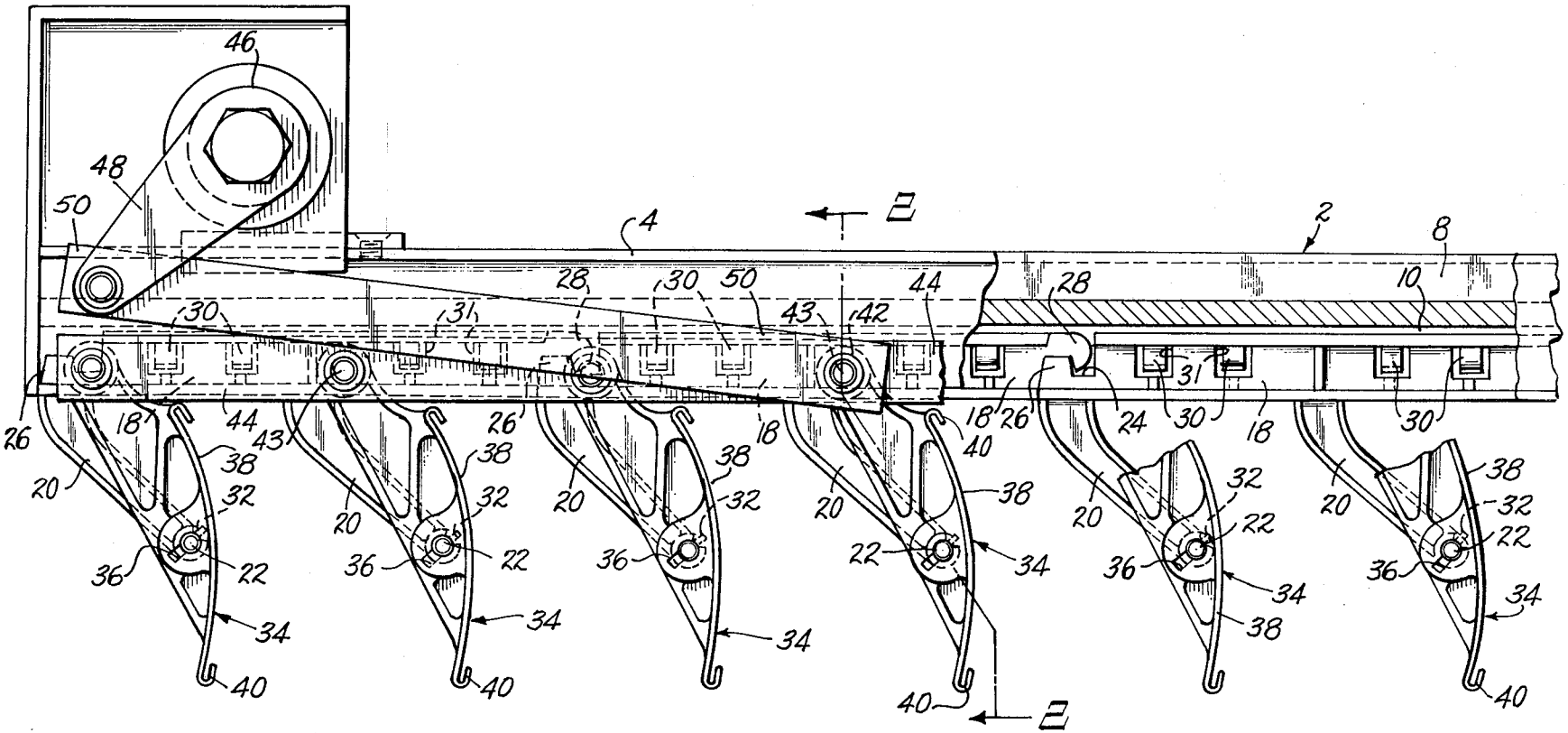
FIG. 1 is a fragmentary side view of one side portion of an adjustable blind structure embodying the present invention, certain parts thereof being broken away to facilitate illustration.
Figure 3:
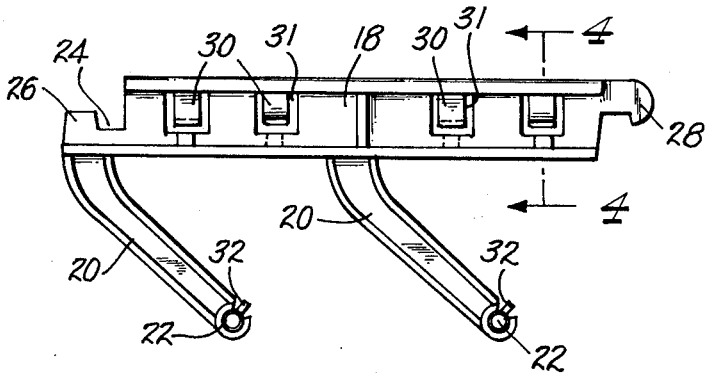
FIG. 3 is a side elevational view of one of the modular bracket units.
Figure 4:
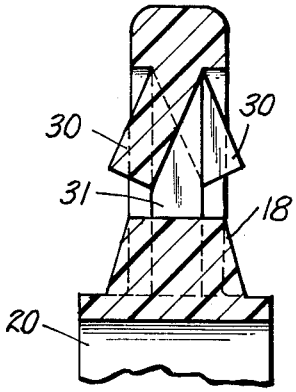
FIG. 4 is an enlarged sectional view taken along the line 4—4 of FIG. 3.

The modular bracket units are best shown in FIGS. 3 and 4 and are preferably formed of molded plastic material. Each bracket comprises a base bar 18, of generally I-bar shape, having a pair of slat brackets 20 integrally formed therewith and extending downwardly therefrom at the general angle shown in FIG. 5. At their lower ends the legs 20 are formed with laterally extending pintles 22 on which slat holders are pivotally mounted as will be described. As shown, one leg 20 extends downwardly from one end of base bar 18 and another leg 20 extends downwardly therefrom at a point midway between the ends of the bar 18. Thus, when a plurality of the brackets are assembled in the manner to be described, a row of equidistantly spaced legs 20 is provided as seen in FIG. 1. One end of each bar, for example, the left hand end seen in FIG. 3, is formed to define an upwardly facing recess 24 adjacent a hook-like portion 26 extending upwardly only about one-half the height of the bar 18. The other end of the bar 18 is somewhat similarly formed but in reverse, that is, it is provided with a downwardly extending hook-like portion 28.

Each base bar 18 is further formed to define downwardly and outwardly extending oblique tabs 30 secured to the base bar 18 at only their upper edges in openings 31. Thus, the tabs 30 are somewhat flexible in a direction lateral to the base bar 18. The tabs 30 are also alternately arranged to extend downwardly and outwardly toward opposite sides of the base bar 18.

Figure 2:
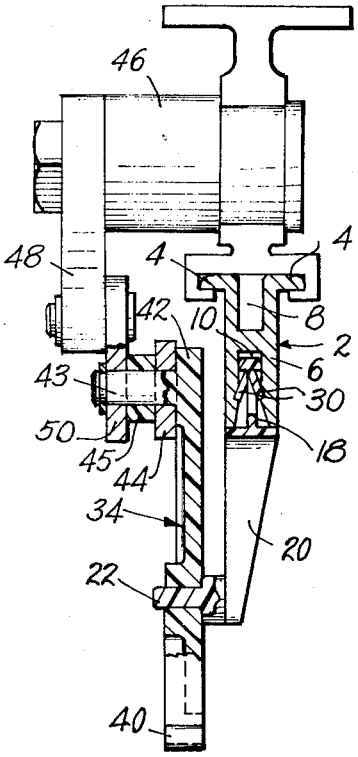
FIG. 2 is a sectional view taken along the line 2—2 of FIG. 1.

As is apparent from FIGS. 1 and 2, a plurality of the modular bracket units may be installed in the supporting bar or rail 2 by merely snapping the same upwardly into channel 10 thereof. The tabs 30 can flex inwardly and then snap into the grooves 12, as shown in FIG. 2. As best seen in FIG. 1, as each succeeding modular bracket is snapped into the channel 10, its recess 24 at one end embraces the hook-like structure 28 at the other end of the previously installed modular bracket unit and thus the units of the assembly of modular units are held against relative longitudinal sliding movement in the channel 10 of rail 2.

Clearly, rail structures may be made and stocked in any desired lengths without regard to the size of the openings with which they are to be used. At installation, the rails are merely cut to the desired length and their flanges 4 secured to the opposite sides of the opening whereupon the bracket structures may be snapped into place rapidly and economically until the desired number of slat supports have been provided.

The pintles 22 previously referred to are each provided at their outer end with a laterally extending locking key 32. A slat support 34 is provided for each bracket leg 20 and each support 34 is provided with a keyhole shaped opening therethrough whereby the slot 36 of the keyhole opening may be aligned with the key 32 and the support thus placed on pintle 22 and then rotated to a position where the key 32 retains it against axial removal from the pintle. Each of the supports 34 is formed with a curved edge portion 38 of a length substantially equal to the width of the slats to be used. At the ends of the surface 38 are reversely bent hooks 40 arranged to overlie and grip the edges of the slats. Each of the supports 34 extends upwardly and defines at its upper end a pivoting formation 42 by which it may be pivoted to an elongated actuating bar 44 having openings therein spaced to receive the pivots of all slat supports. As shown, the pivots referred to are pins 43 integral with the formation 42 the one referred to extending through an opening in actuator bar 44, through a spacer sleeve 45 and through an opening in the end of a connecting rod 50. The spacing between the openings in actuator 44 is equal to the spacing between the pintles 22, as is known, and thus moving the actuator to the right as shown in FIG. 1 will effect closure of the blind whereas movement to the position as shown in FIG. 1 effects opening of the blind for admission of light. It is contemplated that the blind may be actuated by any suitable means such as the rock shaft 46 acting through a crank 48 and the connecting rod 50 pivoted to one of the pivots on a slat support. As indicated in FIG. 2, the support for the rock shaft 46 may embrace the flanges 4 by one of the rails 2. The rock shaft 46 may be actuated by any desired manual or power means, not shown.

Figure 6:
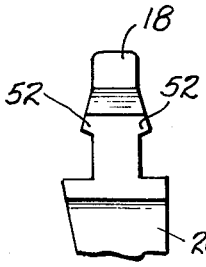
FIG. 6 is an end view of a modular bracket unit illustrating a second embodiment thereof.

FIG. 6 illustrates an alternative embodiment of the modular bracket unit shown in FIG. 3. In ths embodiment, all portions of the bracket unit are identical to those already described except that the flexible tabs 30 are omitted and the base bar 18 is formed to define longitudinally extending rib portions 52 extending along opposite sides thereof, the rib portions being complementary in shape to the angular grooves 12 in channel 10 of rail 2. The ribs 52 may extend continuously from one end of the base bar 18 to the other or they may be of short length, there being one or more along each base bar 18. The material from which the bracket unit is formed is preferably a plastic material having some resilience and it is obvious that the sides of the rail 2 outwardly of the channel 10 will be somewhat flexible. Thus, the bracket unit of FIG. 6 may be forcibly snapped into the channel 10 until the ribs 52 enter the grooves 12 wherein the lower edges of the ribs engage the surfaces 14 to prevent inadvertent removal of the brackets from the rail in a downard direction.

Obviously, after assembly of a complete shutter structure in the manner described, the individual bracket units cannot readily be removed downwardly. However, the entire assembly of bracket units may be disconnected from the actuator 44 and connecting rod 50 and the entire assembly of brackets slid longitudinally outwardly of one end of the channel 10 of rail 2 whereupon any one of the bracket units may be removed for repair or replacement.

While a limited number of embodiments of the invention have been shown and described, it is contemplated that other forms may be resorted to within the scope of the appended claims.

I claim:

1. In an adjustable slat blind mechanism having elongated supports extending along opposite sides of an opening and blind slats extending therebetween and pivoted thereto, the improvement comprising:

each of said supports defining an outwardly open channel extending therealong, the inner side faces of said channel having inwardly facing detent portions;

a plurality of slat brackets in said channel, each having latching portions engaging the said detent portions, each slat bracket having at least one supporting arm extending outwardly away from said channel and having a slat holder pivoted thereto; and interengaging means on said slat brackets holding said brackets against relative movement along said channel whereby said supporting arms are held in predetermined spaced relation.

2. A mechanism as defined in claim 1 wherein said detent portions comprise a groove extending longitudinally along the inner face of each side of said channel, said latching portions comprising projections on opposite sides of said brackets, engaging in said grooves.

3. A mechanism as defined in claim 2 wherein said latching portions comprise resilient tabs extending obliquely from the sides of said brackets toward the open side of said channel whereby said brackets may be snapped into said channel from the open side thereof.

4. A mechanism as defined in claim 2 wherein the sides of said channel are resiliently bendable whereby said brackets may be snapped into said channel from the open side thereof.

5. A mechanism as defined in claim 2 wherein said channels extend through at least one end of their elongated supports whereby said brackets may be slid longitudinally into or out of said channels.

6. A mechanism as defined in claim 1 wherein said interengaging means comprise an inwardly facing recess at one end of each bracket and an outwardly facing hook portion at the other end thereof, the hook portions being engaged in said recesses.

7. A mechanism as defined in claim 1 wherein each bracket has one of said supporting arms at one end thereof and another supporting arm midway between its ends.

* * * * *